US010654186B2

(12) United States Patent
Shimizu et al.

(10) Patent No.: US 10,654,186 B2
(45) Date of Patent: May 19, 2020

(54) TRIMMER

(71) Applicant: Horizon International Inc., Takashima-shi, Shiga (JP)

(72) Inventors: Tomoyuki Shimizu, Takashima (JP); Masamichi Kanao, Takashima (JP); Hideaki Tabuchi, Takashima (JP)

(73) Assignee: HORIZON INTERNATIONAL INC., Takashima-shi, Shiga (JP)

( * ) Notice: Subject to any disclaimer, the term of this patent is extended or adjusted under 35 U.S.C. 154(b) by 0 days.

(21) Appl. No.: 16/437,286

(22) Filed: Jun. 11, 2019

(65) Prior Publication Data

US 2019/0381683 A1 Dec. 19, 2019

(30) Foreign Application Priority Data

Jun. 19, 2018 (JP) ..... 2018-115801

(51) Int. Cl.
*B26D 7/01* (2006.01)
*B26D 1/06* (2006.01)
(Continued)

(52) U.S. Cl.
CPC ..... *B26D 7/015* (2013.01); *B26D 1/06* (2013.01); *B26D 5/005* (2013.01); *B26D 7/0675* (2013.01);
(Continued)

(58) Field of Classification Search
CPC .... Y10S 83/904; Y10S 83/934; Y10T 83/744; Y10T 83/745; Y10T 83/0524; Y10T 83/0572; Y10T 83/148; Y10T 83/141; Y10T 83/152; Y10T 83/162; Y10T 83/173; Y10T 83/175; Y10T 83/178; Y10T 83/18; Y10T 83/2029; Y10T 83/4458; Y10T 83/4577; Y10T 83/4579; Y10T 83/5669; Y10T 83/5696; Y10T 83/5733; Y10T 83/5742; Y10T 83/5815; Y10T 83/5824; Y10T 83/6492; Y10T 83/652; Y10T 83/6518; Y10T 83/7487; Y10T 83/7593;
(Continued)

(56) References Cited

U.S. PATENT DOCUMENTS

2003/0145703 A1* 8/2003 Rohe-Krebeck ..... B26D 7/015 83/277
2005/0066781 A1* 3/2005 Begemann ..... B26D 1/02 83/13
(Continued)

FOREIGN PATENT DOCUMENTS

JP 2016-221619 A 12/2016

*Primary Examiner* — Phong H Nguyen
(74) *Attorney, Agent, or Firm* — Westerman, Hattori, Daniels & Adrian, LLP

(57) ABSTRACT

The trimmer includes: a pusher 2 that pushes the bound material 1; a pusher moving device that moves the pusher; a positioning part 111 that positions the bound material pushed by the pusher; an allowable position memory that memorizes an allowable position range relevant to the pusher; an allowable reaction force memory that memorizes an allowable reaction force range relevant to the pusher; and a determiner that determines whether a length of the bound material is normal or abnormal. The determiner determines that: the length L of the bound material is normal; or the length L of the bound material is abnormal.

5 Claims, 9 Drawing Sheets

(51) Int. Cl.
*B26D 7/06* (2006.01)
*B26D 5/00* (2006.01)
*B26D 7/00* (2006.01)

(52) U.S. Cl.
CPC ..... *B26D 2007/0081* (2013.01); *Y10S 83/904* (2013.01); *Y10S 83/934* (2013.01)

(58) Field of Classification Search
CPC .... Y10T 83/822; B26D 7/015; B26D 7/0675; B26D 7/01; B26D 1/06; B26D 1/065; B26D 1/08; B26D 1/09; B26D 1/10; B26D 1/11; B26D 1/115; B26D 2007/0081; B26D 5/00; B26D 5/005
See application file for complete search history.

(56) References Cited

U.S. PATENT DOCUMENTS

2007/0209492 A1* 9/2007 Schmid ..... B26D 5/34 83/33
2009/0000440 A1* 1/2009 Graushar ..... B26D 1/085 83/52
2011/0017032 A1* 1/2011 Hutchins ..... B26D 1/09 83/39

* cited by examiner

TRIMMER

TECHNICAL FIELD OF THE INVENTION

The present invention relates to a trimmer that trims a bound material during a finish processing of a book binding process.

BACKGROUND OF THE INVENTION

A trimmer is described in Patent Document 1 (JP2016-221619A) as a three-side trimmer. The three-side trimmer is used so as to trim each of top edge, bottom edge and fore-edge areas of a bound material during a finish processing of a book binding process. The bound material includes a book block and a cover attached on the book block.

As shown in FIG. 1 of Patent Document 1, in case of the three-side trimmer, the bound material 1 is conveyed by a belt conveyer 100 so as to be positioned by abutting against a first positioning part 110. The trimmer includes a pusher 2 disposed on the fore-edge area 1*a* side of the bound material 1. The bound material 1 positioned by the first positioning part 110 is pushed by the pusher 2 so as to be conveyed toward a fore-edge trimming part 52 that trims the fore-edge area of the bound material 1.

The fore-edge trimming part 52 includes a fore-edge trimming blade 3. The bound material 1 conveyed to the fore-edge trimming part 52 is positioned in such a way that the fore-edge area 1*a* of the bound material 1 is disposed below the fore-edge trimming blade 3. The fore-edge trimming blade 3 falls toward a trimming position from a non-trimming position so as to trim the fore-edge area 1*a* of the bound material 1. The bound material 1 comprising the trimmed fore-edge area 1*a* is gripped by a chuck device 15 so as to be conveyed toward a top and bottom edges trimming part 53 that trims the top and bottom edges 1*b* and 1*c* of the bound material 1.

By the way, each of the bound materials 1 may be different respectively in length since errors occur with respect to the amount of the folding of the papers of the bound material 1, the amount of the glue applied on the paper of the bound material 1, the amount of the milling of the bound material 1 and so on when making the bound material 1 before trimming it. There is no problem when the length of the bound material 1 before trimmed is in the allowable range (normal case). On the other hand, there is a problem when the length of the bound material 1 before trimmed is large or small beyond the allowable range (abnormal case).

In the three-side trimmer, a position where the pusher 2 should be stopped is preset depending on the length of the bound material 1 before trimmed. However, there is a problem that the bound material 1 cannot be trimmed precisely since the bound material 1 cannot be positioned correctly when the length of the bound material 1 before trimmed is abnormal.

Patent Document 1: JP 2016-221619 A

Problems to be Solved by the Invention

It is an object of the present invention to provide a trimmer that determines whether the length of the bound material is normal or abnormal so as to take an appropriate action, such as remove the bound material having the abnormal length before trimmed.

Solution to the Problems

In order to achieve the objects, the present invention provides a trimmer that trims the bound material, comprising:

a pusher that pushes the bound material;

a pusher moving device that moves the pusher;

a positioning part that positions the bound material pushed by the pusher;

a position detector that detects a stopped position where the pusher is stopped;

a reaction force detector that detects a reaction force to which the pusher is subject;

a set position memory that memorizes a set standby position and a set stop position, the set standby position being a position where the pusher should be standby, the set stop position being a position where the pusher should be stopped;

an allowable position memory that memorizes an allowable position range relevant to the pusher;

an allowable reaction force memory that memorizes an allowable reaction force range relevant to the pusher; and a determiner that determines whether a length of the bound material is normal or abnormal;

wherein the pusher moving device is configured to stop the pusher when the reaction force of the pusher arrives at an upper limit of the allowable reaction force range while the pusher is moved from the set standby position toward the set stop position; and wherein the determiner determines that:

the length of the bound material is normal when the stopped position of the pusher is in the allowable position range, and the reaction force of the pusher is in the allowable reaction force range; or the length of the bound material is abnormal when the stopped position of the pusher is out of the allowable position range, or the reaction force of the pusher is out of the allowable reaction force range.

According to further preferred embodiment of the present invention, wherein the pusher moving device comprises a servomotor;

wherein the position detector is configured to detect a rotational position of the servomotor; and wherein the reaction force detector is configured to detect an amount of s torque of the servomotor.

According to further preferred embodiment of the present invention, wherein the pusher comprises:

a pushing plate that pushes the bound material; and a spring connected with the pushing plate;

wherein the reaction force detector is configured to detect an amount of displacement of the spring.

According to further preferred embodiment of the present invention, wherein the trimmer is stopped when the determiner determines that the length of the bound material is abnormal.

According to further preferred embodiment of the present invention, wherein the trimmer is a three-side trimmer;

wherein the trimmer comprises:

a fore-edge trimming part that trims a fore-edge area of the bound material; and a top and bottom edges trimming part that trims top and bottom edge areas of the bound material; and wherein the positioning part is mounted on the fore-edge trimming part.

Effect of the Invention

The trimmer according to the present invention can determine whether the length of the bound material is normal or abnormal. As a result, an appropriate action, such as removing the bound material having an abnormal length, can be taken.

DETAILED EXPLANATION OF THE PREFERRED EMBODIMENTS

A trimmer according to the present invention will be explained hereinbelow with reference to the figures.

Figure 1:
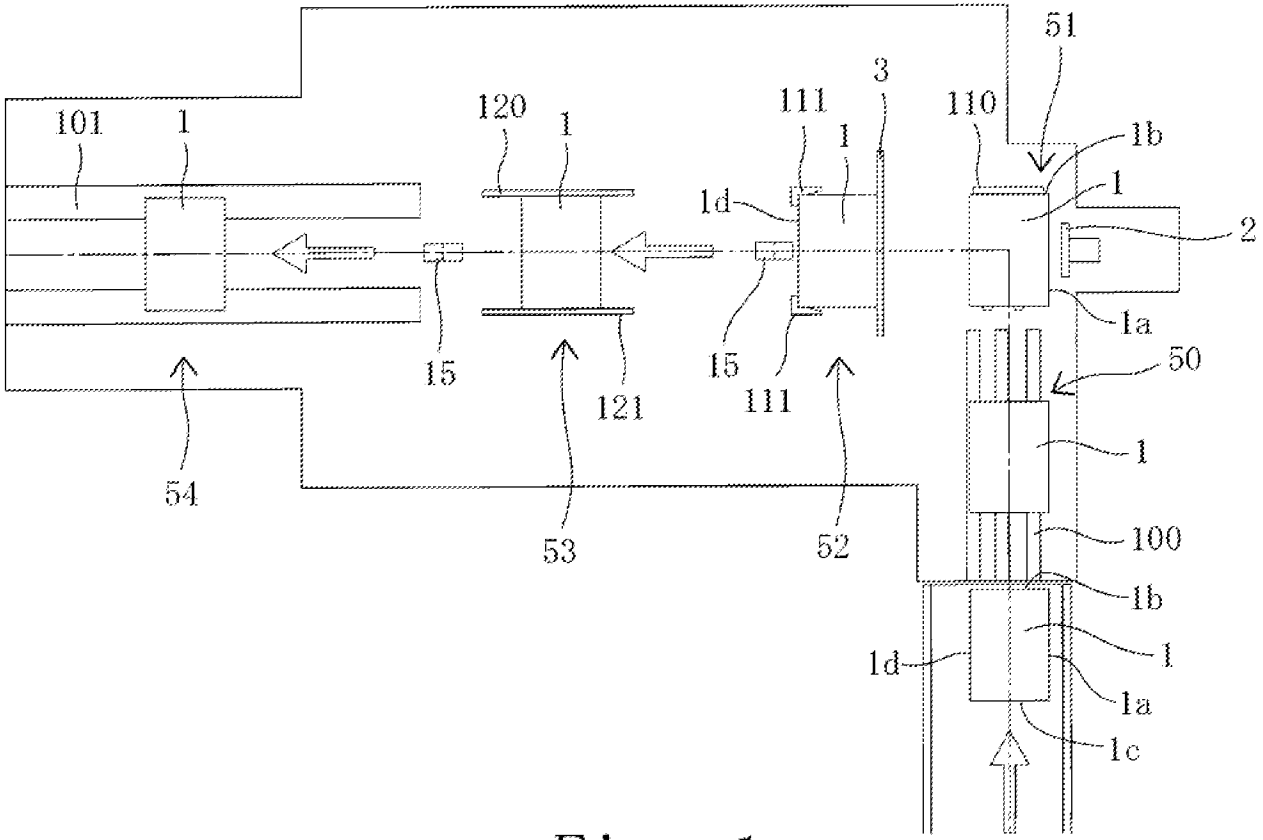
FIG. 1 is a plan view showing a three-side trimmer.

As shown in FIG. 1, the trimmer of this embodiment is a three-side trimmer. A bound material 1 includes a fore-edge area 1*a*, a top edge area 1*b*, a bottom edge area 1*c* and a back-edge area 1*d*. The three-side trimmer is configured to trim the fore-edge, top edge and bottom edge areas 1*a*, 1*b* and 1*c* so as to make the bound material 1 having a predetermined size.

The three-side trimmer includes a carry-in part 50, a standby part 51, a top and bottom edges trimming part 52 and a carry-out part 54. The bound material 1 is conveyed toward the standby part 51 and by a belt conveyer 100 disposed on the carry-in part 50. The top edge area 1*b* of the bound material 1 abuts against a first positioning part 110 with which the standby part 51 is provided, as a result, the bound material 1 is positioned.

Then, a pusher 2 is moved from the standby part 51 toward the fore-edge trimming part 52. As a result, the bound material 1 is pushed by the pusher 2 and conveyed toward the fore-edge trimming part 52. The back-edge area 1*d* of the bound material 1 abuts against a second positioning part 111 with which the fore-edge trimming part 52 is provided, as a result, the bound material 1 is positioned.

The fore-edge area 1*a* of the bound material 1 is trimmed by a fore-edge blade 3 with which the fore-edge trimming part 52 is provided. Then, the bound material 1 is gripped by a chuck part 15 and conveyed toward the top and bottom edges trimming part 53. The top and bottom edge areas 1*b* and 1*c* of the bound material 1 is trimmed by top edge and bottom edge blades 120 and 121 with which the top and bottom edges trimming part 53 is provided. Then, the bound material 1 is gripped by the chuck part 15 and conveyed toward the carry-out part 54. And then, the bound material 1 is carried out by a belt conveyer 101 with which the carry-out part 54 is provided.

Figure 2:
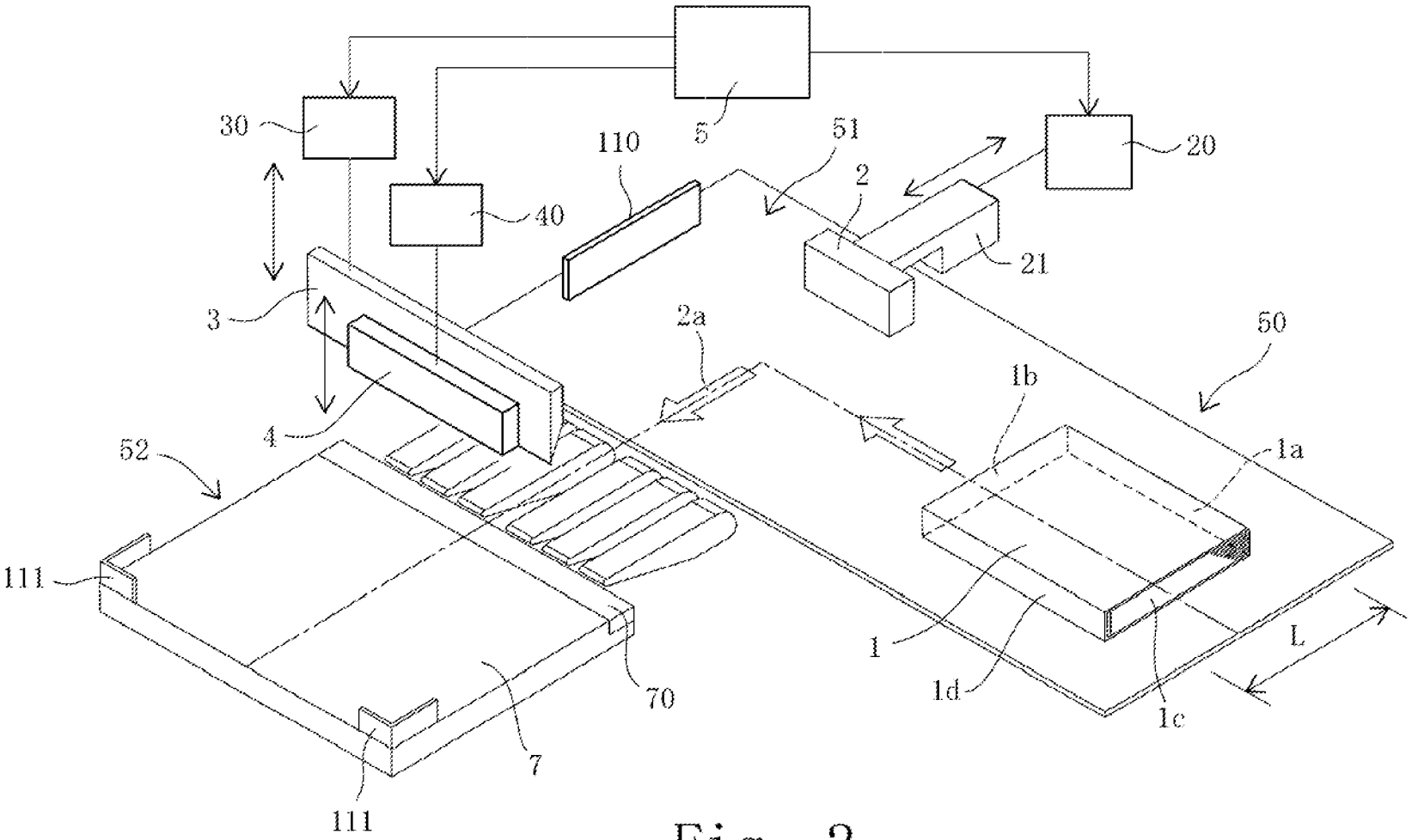
FIG. 2 is a schematic perspective view showing a carry-in part, a standby part and a fore-edge area trimming part with which the three-side trimmer is provided.

As shown in FIG. 2, the three-side trimmer includes a body part 21 connected with the pusher 2. The body part 21 is connected with a pusher moving device 20. The pusher moving device 20 is configured to move both the body part 21 and the pusher 2 horizontally in a longitudinal direction.

The three-side trimmer includes a trimming blade moving device 30 that moves vertically between a trimming position and a non-trimming position. The trimming position is a position where the fore-edge trimming blade 3 trims the fore-edge area 1*a* of the bound material 1, while the non-trimming position is a position where the fore-edge trimming blade 3 is away from the bound material 1.

The three-side trimmer includes a fore-edge pressing plate 4 that presses the bound material 1 when trimming the bound material 1 with the fore-edge trimming blade 3. The three-side trimmer includes a pressing plate moving device 40 that moves the fore-edge plate 4 between a press position and a non-press position.

The press position is disposed on a position where the fore-edge pressing plate 4 presses the fore-edge area 1*a* of the bound material 1, while the non-press position is disposed on a position where the fore-edge pressing plate 4 is away from the bound material 1. Detailed explanation about the trimming blade moving device 30 and the pressing plate moving device 40 is omitted because they are included of a well-known ball screw device, a well-known link device and so on. The three-side trimmer includes a tray 7 that places the bound material 1. The tray 7 includes a blade receiving 70 that receives an edge of the fore-edge trimming blade 3.

The three-side trimmer includes a controller 5 that controls the pusher moving device 20, the trimming blade moving device 30 and the pressing plate moving device 40.

Figure 3:
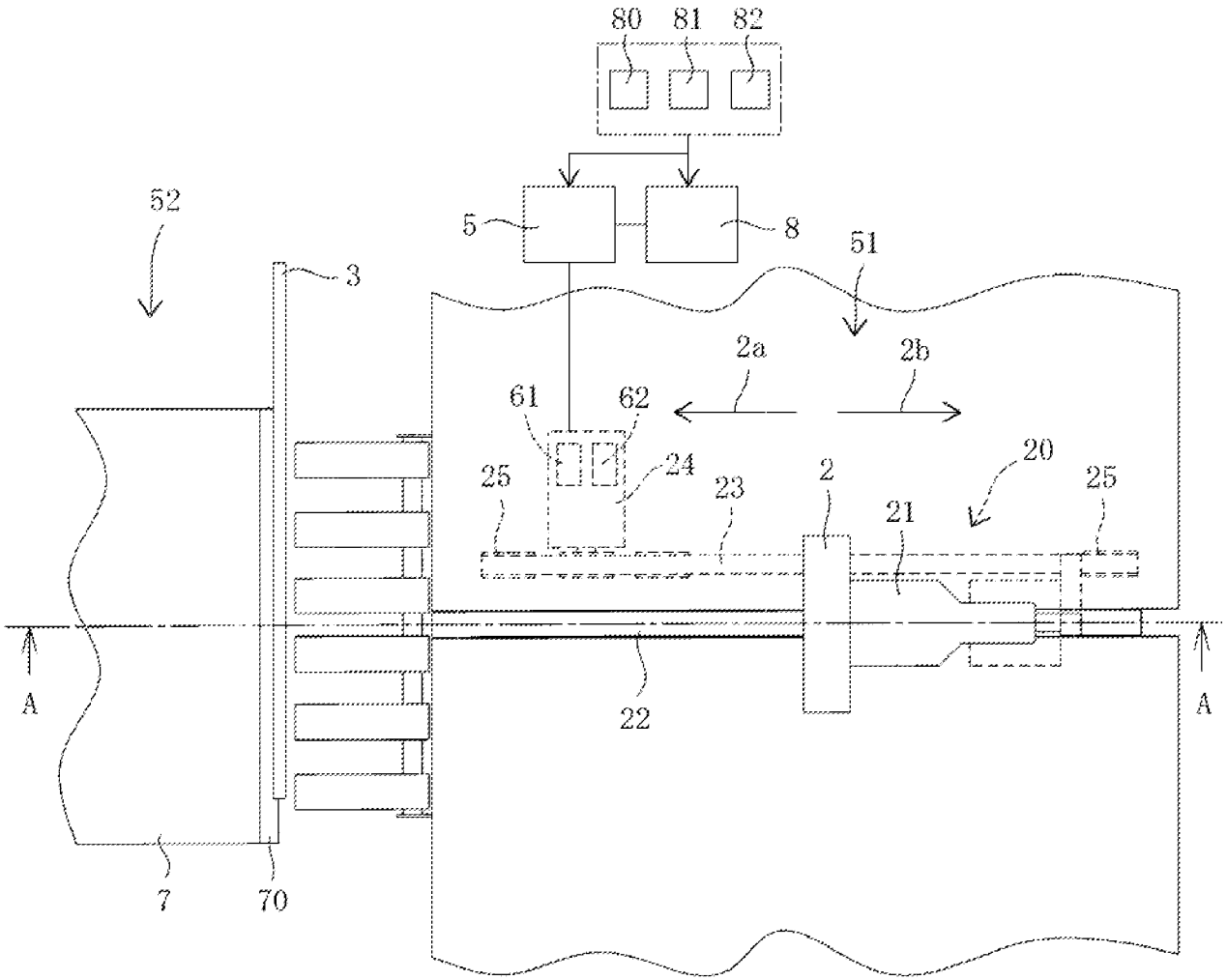
FIG. 3 is a plan view showing the standby part and the fore-edge area trimming part of the three-side trimmer.
Figure 4:
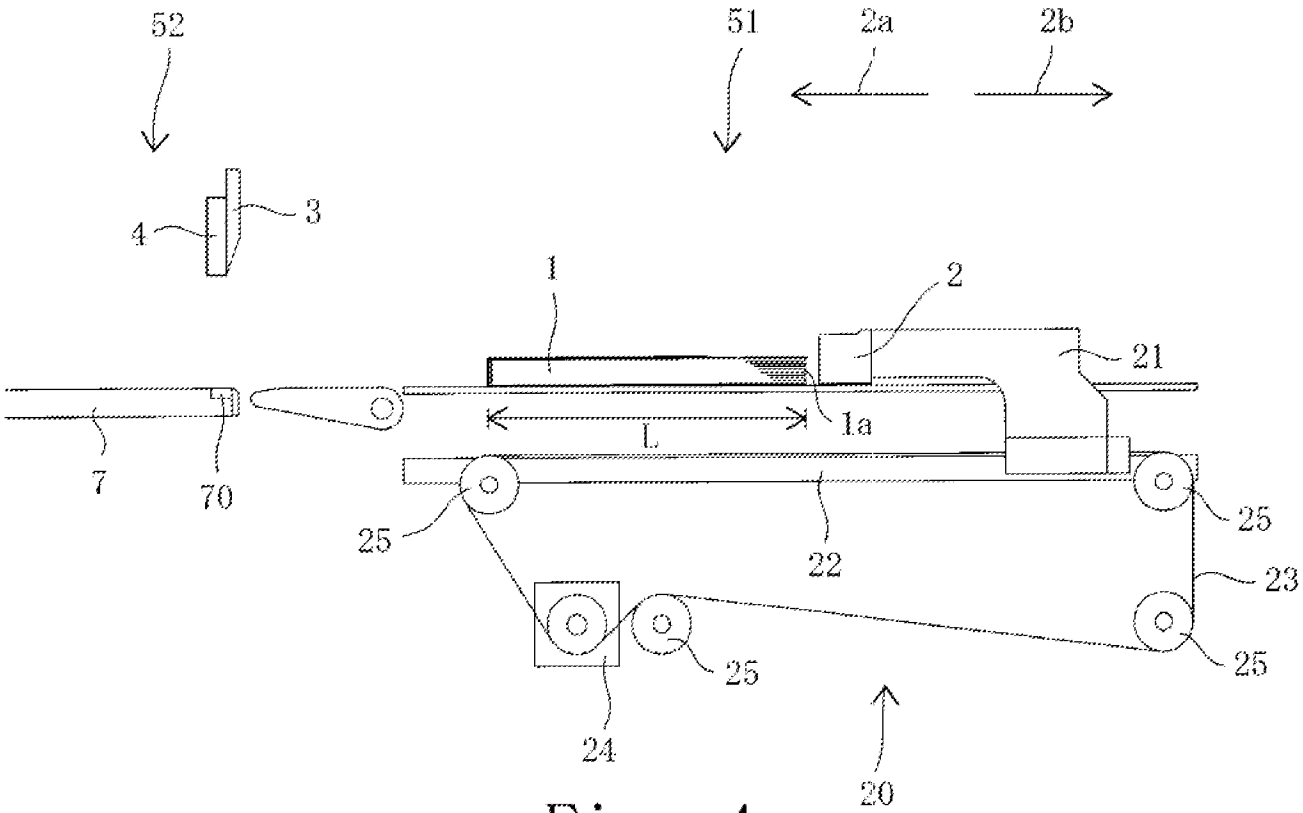
FIG. 4 is a cross-sectional view taken along line A-A in FIG. 3.

As shown in FIGS. 3 and 4, the pusher moving device 20 includes a guide rail 22 extended in a conveying direction 2*a* (a reverse conveying direction 2*b*). The body part 21 connected with the pusher 2 is engaged with the guide rail 22 for slide movement. The pusher moving device 20 includes a belt 23 attached to the body part 21. The belt 23 is extended between a plurality of rollers 25 and a servomotor 24. The pusher 2 along with the body part 21 is moved in a conveying direction 2*a* (a reverse conveying direction 2*b*) by normal and reverse rotations of the servomotor 24.

As shown in FIG. 3, the three-side trimmer includes a set position memory 80. The set position memory 80 is configured to memorize a set standby position SP0 and a set stop position SP1. The set standby position SP0 is a position where the pusher 2 should standby, while the set stop position SP1 is a position where the pusher 2 should stop. The set standby position SP0 is disposed on the standby part 51. The set stop position SP1 is disposed on the fore-edge trimming part 52. The controller 5 is configured to drive the pusher moving device 20 (the servomotor 24) based on a signal from the set position memory 80 and so on.

The set standby position SP0 and the set stop position SP1 is preset according to the length L of the bound material 1. The length L of the bound material 1 means a distance between a portion abutted against the second positioning part 111 and a portion pushed by the pusher 2, in the case of this embodiment, a distance between the back-edge area 1*d* abutted against the second positioning part 111 and the fore-edge area 1*a* pushed by the pusher 2 (FIG. 2).

As shown in FIG. 4, the pusher 2 waits at the set standby position SP0 when the bound material 1 is conveyed from the carry-in part 50 toward the standby part 51. At this time, the pusher 2 is away from the fore-edge area 1*a* of the bound material 1.

Figure 5:
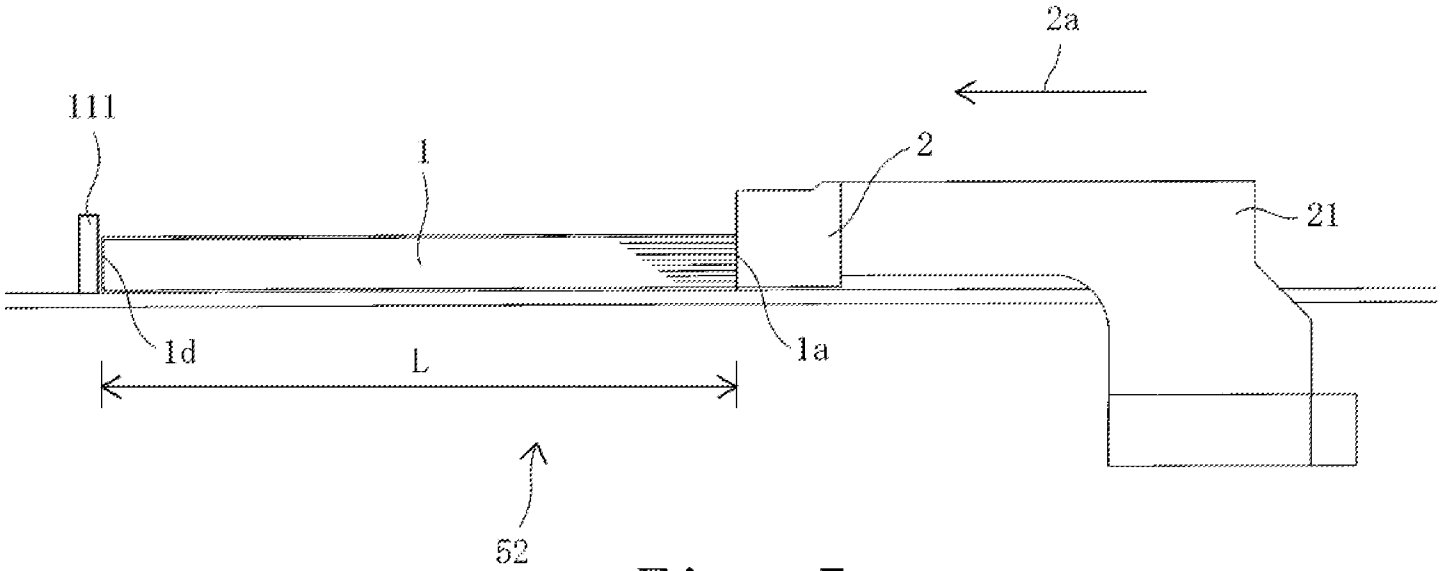
FIG. 5 is a cross-sectional view taken along line A-A in which a pusher is stopped at a stopped position.

Then, as shown in FIG. 5, the pusher 2 moves in the conveying direction 2*a* so as to push the fore-edge area 1*a* of the bound material 1. The back-edge area 1*d* of the bound material 1 is pushed against the second positioning part 111 of the fore-edge trimming part 52, then, the pusher 2 is stopped at the set stop position SP1.

Figure 6:
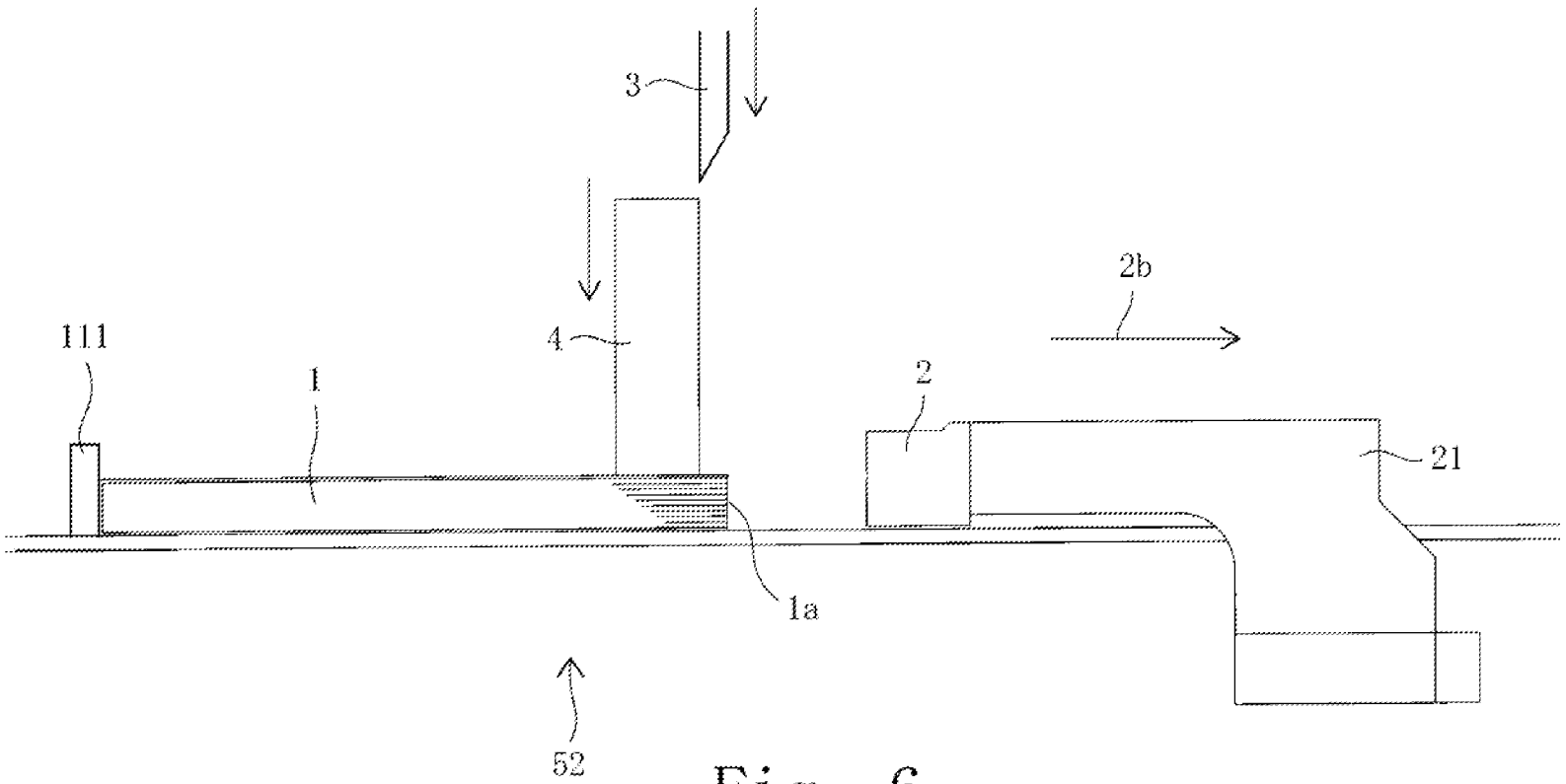
FIG. 6 is a cross-sectional view taken along line A-A in which a fore-edge area press plate presses the bound material.
Figure 7A:
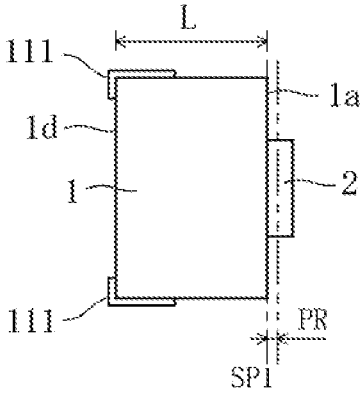
FIGS. 7(*a*) to 7(*d*) are plan views showing a relationship in position between the bound material and the pusher.
Figure 7C:
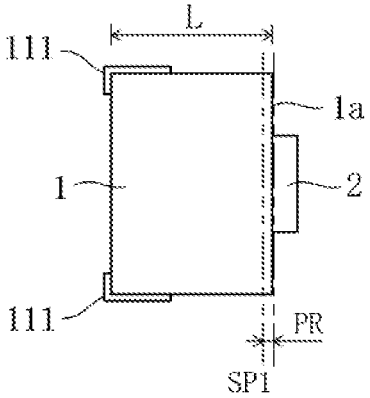
Figure 7B:
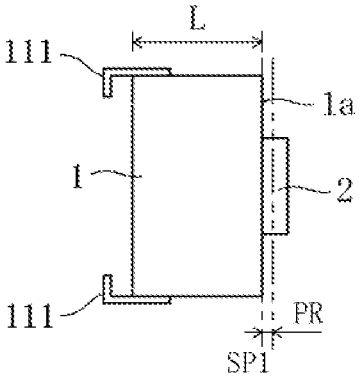
Figure 7D:
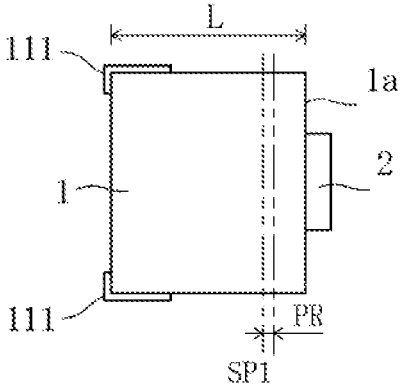
Figure 8A:
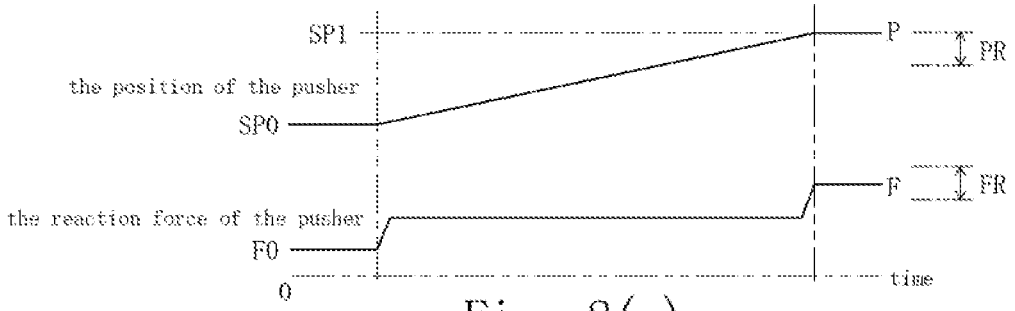
FIGS. 8(*a*) to 8(*d*) are timing charts showing both a position and a reaction force relevant to the pusher corresponding to FIGS. 7(*a*) to 7(*d*).
Figure 8B:
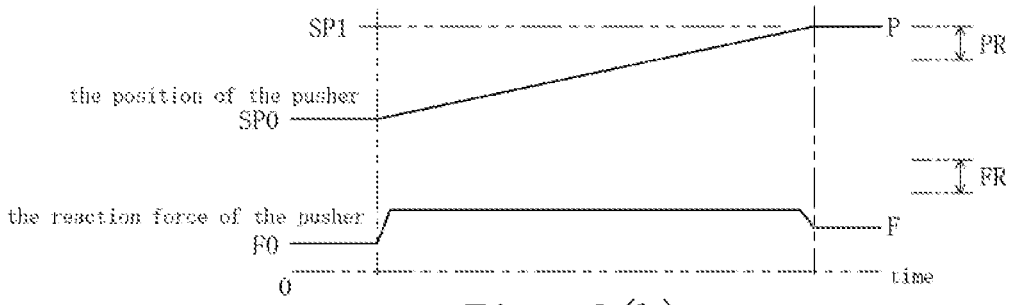
Figure 8C:
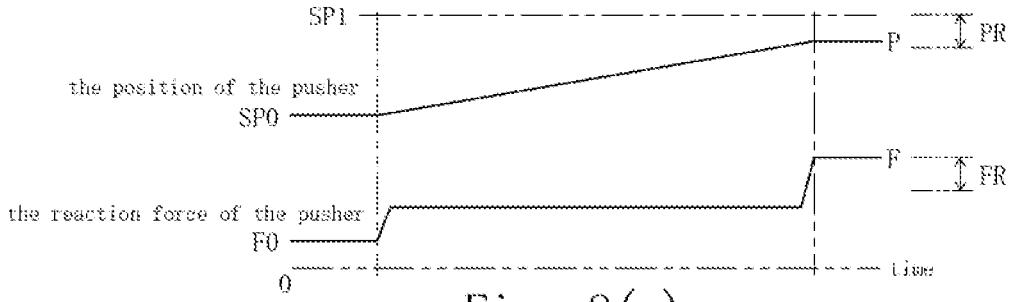
Figure 8D:
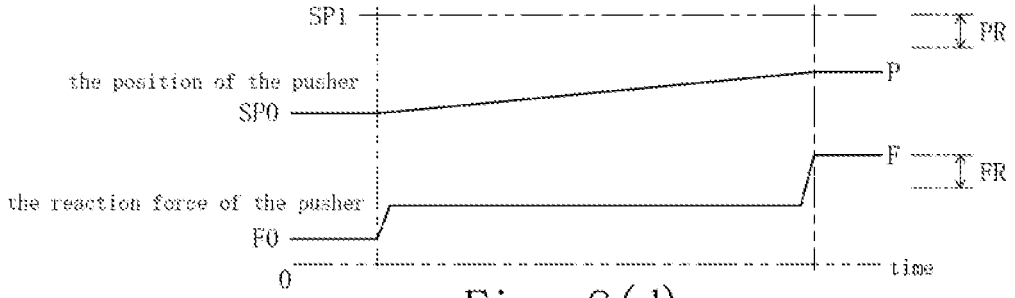

And then, as shown in FIG. 6, the fore-edge pressing plate 4 is lowered to the press position from the non-pressing position so as to press the bound material 1. The pusher 2 moves in the reverse conveying direction 2*b* so as to return toward the set standby position SP0. The fore-edge trimming blade 3 is lowered to the trimming position from the non-trimming position so as to trim the fore-edge area 1*a* of the bound material 1 while the fore-edge pressing plate 4 presses the bound material 1.

As shown in FIG. 3, the three-side trimmer includes a position detector 61 that detects a stopped position P where the pusher 2 is stopped. The three-side trimmer includes a reaction force detector that detects a reaction force F to which the pusher 2 is subject. In this embodiment, the position detector 61 is configured to detect the rotational position of the servomotor 24, while the reaction force detector 62 is configured to detect the amount of the torque of the servomotor 24.

The three-side trimmer includes an allowable position memory 81 that memorizes an allowable position range PR relevant to the pusher 2. The allowable position range PR is preset in such a way that the stopped position P of the pusher 2 is in the allowable position range PR when the length L of the bound material 1 is normal, while the stopped position P of the pusher 2 is not in the allowable position range PR when the length L of the bound material 1 is abnormal. The allowable position range PR is, for example, set to be in the range of 3 mm around the set stop position SP1.

The three-side trimmer includes an allowable reaction force memory 82 that memorizes an allowable reaction force range FR relevant to the pusher 2. The pusher moving device 20 is configured to stop the pusher 2 when the reaction force F of the pusher 2 arrives at an upper limit of the allowable reaction force range FR. Therefore, the reaction force F of the pusher 2 does not exceed the allowable reaction force range FR. As a result, the reaction force F of the pusher 2 is in the allowable reaction force range FR when the bound material 1 abuts against the second positioning part 111.

Further, the allowable reaction force range FR is preset in such a way that the reaction force F of the pusher 2 is lower than a lower limit of the allowable reaction force range FR when the bound material 1 does not abut against the second positioning part 111.

In this embodiment, an operator can input the allowable position range PR and the allowable reaction force range FR according to the bound material 1 with input means (not shown), such as a touch screen and so on.

The pusher moving device 20 is configured to stop the pusher 2 when the reaction force F of the pusher 2 exceeds the upper limit of the allowable reaction force range FR while the pusher 2 moves from the set standby position SP0 toward the set stop position SP1. Therefore, as described later, the pusher 2 might be stopped before arriving at the set stop position SP1.

The three-side trimmer includes a determiner 8 that determines whether the length L of the bound material 1 is normal or abnormal. The determiner 8 determines it based on decision criteria of the followings (i) and (ii).

(i) The length L of the bound material 1 is normal when the stopped position P of the pusher 2 is in the allowable position range PR, and the reaction force F of the pusher 2 is in the allowable reaction force range FR.

(ii) The length L of the bound material 1 is abnormal when the stopped position P of the pusher 2 is out of the allowable position range PR, or the reaction force F of the pusher 2 is out of the allowable reaction force range FR.

The controller 5 is configured to stop the movement of the three-side trimmer and to alarm the operator with alarming means (not shown) such as a siren and so on when the length L of the bound material 1 is determined as abnormal by the determiner 8. Further, the operator can remove the abnormal bound material 1 before trimmed.

Referring to FIGS. 7(*a*) to 8(*d*), a process for determining in the determiner 8 will be explained in detail.

<Case 1>

Referring to FIGS. 7(*a*) and 8(*a*), a process for determining the bound material 1 in the case 1 will be explained.

The pusher 2 is stopped at the set stop position SP1 since the reaction force F of the pusher 2 does not arrive at the upper limit of the allowable reaction force range FR while the pusher 2 is moved from the set standby position SP0 toward the set stop position SP1. That is to say, the stopped position P of the pusher 2 is the same position as the set stop position SP1 and in the allowable position range PR.

The reaction force F of the pusher 2 is in the allowable reaction force range FR when the pusher 2 is stopped. It is understood that the bound material 1 abuts against the second positioning part 111 so as to stop because the reaction force F of the pusher 2 is in the allowable reaction force range FR.

Therefore, in this case, the back-edge area 1*d* of the bound material 1 abuts against the second positioning part 111, and the fore-edge area 1*a* of the bound material 1 is in the allowable position range PR. Thus, the length L of the bound material 1 has a length from the second positioning part 111 toward the allowable position range PR. As a result, the determiner 8 determines that the length L of the bound material 1 is normal.

<Case 2>

Referring to FIGS. 7(*b*) and 8(*b*), a process for determining the bound material 1 in the case 2 will be explained.

The pusher 2 is stopped at the set stop position SP1 since the reaction force F of the pusher 2 does not arrive at the upper limit of the allowable reaction force range FR while the pusher 2 is moved from the set standby position SP0 toward the set stop position SP1. That is to say, the stopped position P of the pusher 2 is the same position as the set stop position SP1 and is in the allowable position range PR.

The reaction force F is lower than the lower limit of the allowable reaction force range FR when the pusher 2 stops. It is understood that the bound material 1 does not abut against the second positioning part 111 because the reaction force F of the pusher 2 is lower than the lower limit of the allowable reaction force range FR.

Therefore, in this case, the back-edge area 1*d* of the bound material 1 does not abut against the second positioning part 111, and the fore-edge area 1*a* of the bound material 1 is in the allowable position range PR. Thus, the length L of the bound material 1 is shorter than a length from the second positioning part 111 to the allowable position range PR. As a result, the determiner 8 determines that the length L from the back-edge area 1*d* of the bound material 1 to the fore-edge area 1*a* thereof is abnormal.

<Case 3>

Referring to FIGS. 7(*c*) and 8(*c*), a process for determining the bound material 1 in the case 3 will be explained.

The pusher 2 stops in front of the set stop position SP1 since the reaction force F of the pusher 2 arrives at the upper limit of the allowable reaction force range FR while the pusher 2 moves from the set standby position SP0 to the set stop position SP1. That is to say, the stopped position P of the pusher 2 is at the different position from the set stop position SP1. In this case, the stopped position P of the pusher 2 is in the allowable position range PR.

The reaction force F is equal to the upper limit of the allowable reaction force range FR when the pusher 2 stops. It is understood that the bound material 1 abuts against the second positioning part 111 so as to stop because the reaction force F of the pusher 2 is equal to the upper limit of the allowable reaction force range FR.

Therefore, in this case, the back-edge area 1*d* of the bound material 1 abuts against the second positioning part 111, and the fore-edge area 1*a* of the bound material 1 is in the allowable position range PR. Thus, the length L of the bound material 1 has a length from the second positioning part 111 to the allowable position range PR. As a result, the determiner 8 determines that the length L of the bound material 1 is normal.

<Case 4>

Referring to FIGS. 7(*d*) and 8(*d*), a process for determining the bound material 1 in the case 4 will be explained.

The pusher 2 stops in front of the set stop position SP1 since the reaction force F of the pusher 2 arrives at the upper limit of the allowable reaction force range FR while the pusher 2 moves from the set standby position SP0 to the set stop position SP1. That is to say, the stopped position P of the pusher 2 is at the different position from the set stop position SP1. In this case, the stopped position P of the pusher 2 is not in the allowable position range PR and is out of the allowable position range PR.

The reaction force F is equal to the upper limit of the allowable reaction force range FR when the pusher 2 stops. It is understood that the bound material 1 abuts against the second positioning part 111 so as to stop because the reaction force F of the pusher 2 is equal to the upper limit of the allowable reaction force range FR.

Therefore, in this case, the back-edge area 1*d* of the bound material 1 abuts against the second positioning part 111, and the fore-edge area 1*a* of the bound material 1 is not in the allowable position range PR and is out of the allowable position range PR. Thus, the length L of the bound material 1 is longer than the length from the second positioning part 111 to the allowable position range PR. As a result, the determiner 8 determines that the length L of the bound material 1 is abnormal.

Another Embodiment

The position detector 61 may be composed of a well-known encoder, a well-known displacement sensor and so on. The reaction force detector 62 is composed of a well-known torque sensor, a well-known load cell and so on.

Figure 9:
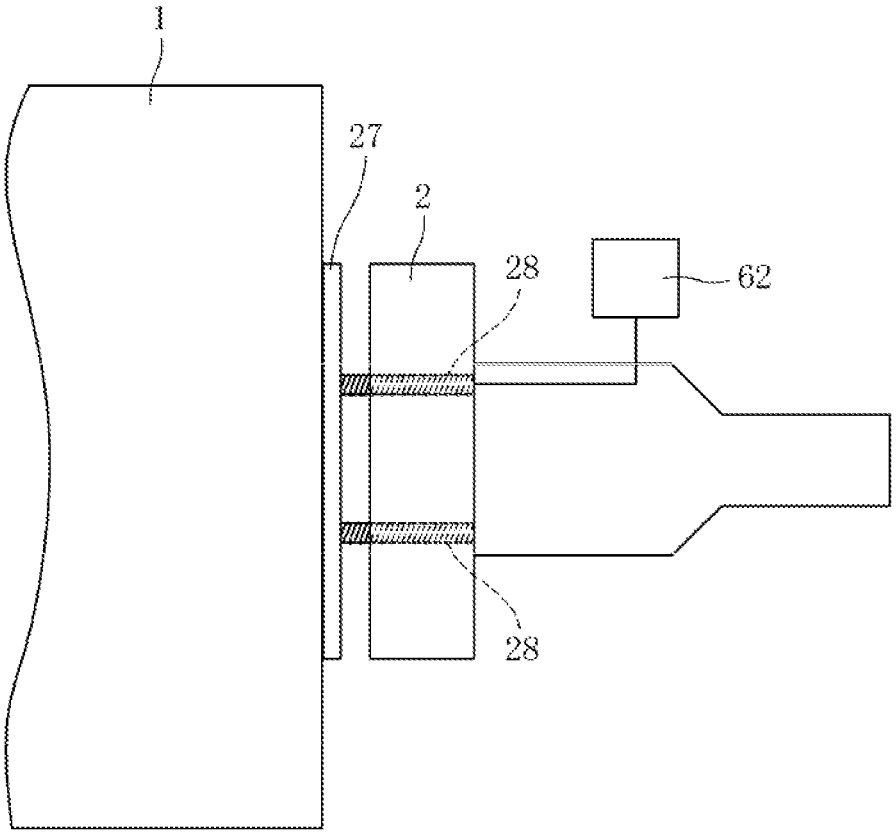
FIG. 9 is a plan view showing another embodiment of a reaction force detector.

As shown in FIG. 9, the pusher 2 may include a pushing plate 27 that pushes the bound material 1, and the spring 28 connected with the pushing plate 27. The reaction force detector 62 may be configured to detect the amount of displacement of the spring 28.

There is a problem when the upper limit of the allowable reaction force range FR is set to be high even though the bound material 1 has a thin. The problem is that the pusher 2 further pushes and bends the bound material 1 because the reaction force F of the pusher 2 does not arrive at the upper limit of the allowable reaction force range FR if even the bound material 1 abuts against the second positioning part 111. Therefore, the allowable reaction force range FR is automatically calculated based on the thickness of the bound material 1 and so on in such a way that the bound material 1 is not bent by the pusher 2.

The three-side trimmer may include discharging means (not shown) that discharge the predetermined bound material 1 from the trimming process. The three-side trimmer may remove the abnormal bound material 1 automatically before trimming by the discharging means based on the signal from the determiner 8.

The second positioning part 111 may be mounted on the standby part 51. In this case, both the set standby position SP0 and the set stop position SP1 are disposed on the standby part 51. The pusher 2 moves so as to push the bound material 1, and the bound material 1 is abutted and positioned against the second positioning part 111. The bound material 1 is positioned at the standby part 51. Then, the positioned bound material 1 is gripped by the chuck device 15, and then, the chuck device 15 conveys the bound material 1 toward the fore-edge trimming part 52.

Some preferable embodiments of the present invention are explained, but the structural features of the present invention are not limited to this embodiment.

EXPLANATION OF CODES

1: bound material
1*a*: fore-edge area of bound material
5: controller
51: standby part
52: fore-edge trimming part
2: pusher
2*a*: conveying direction
2*b*: reverse conveying direction
20: pusher moving device
61: position detector
62: reaction force detector
8: determiner
80: set position memory
81: allowable position memory
82: allowable reaction force memory
111: second positioning part
SP0: set standby position
SP1: set stop position
P: stopped position
F: reaction force
PR: allowable position range
FR: allowable reaction force range
L: length of bound material

What is claimed is:

1. A trimmer that trims the bound material, comprising:
a pusher that pushes the bound material;
a pusher moving device that moves the pusher;
a positioning part that positions the bound material pushed by the pusher;
a position detector that detects a stopped position where the pusher is stopped;
a reaction force detector that detects a reaction force to which the pusher is subject;
a set position memory that memorizes a set standby position and a set stop position, the set standby position being a position where the pusher should be standby, the set stop position being a position where the pusher should be stopped;
an allowable position memory that memorizes an allowable position range relevant to the pusher;

an allowable reaction force memory that memorizes an allowable reaction force range relevant to the pusher; and a determiner that determines whether a length of the bound material is normal or abnormal;

wherein the pusher moving device is configured to stop the pusher when the reaction force of the pusher arrives at an upper limit of the allowable reaction force range while the pusher is moved from the set standby position toward the set stop position; and wherein the determiner determines that:

the length of the bound material is normal when the stopped position of the pusher is in the allowable position range, and the reaction force of the pusher is in the allowable reaction force range; or the length of the bound material is abnormal when the stopped position of the pusher is out of the allowable position range, or the reaction force of the pusher is out of the allowable reaction force range.

2. A trimmer according to claim 1, wherein the pusher moving device comprises a servomotor;

wherein the position detector is configured to detect a rotational position of the servomotor; and wherein the reaction force detector is configured to detect an amount of a torque of the servomotor.

3. A trimmer according to claim 1, wherein the pusher comprises:

a pushing plate that pushes the bound material; and a spring connected with the pushing plate;

wherein the reaction force detector is configured to detect an amount of displacement of the spring.

4. A trimmer according to any one of claim 1, wherein the trimmer is stopped when the determiner determines that the length of the bound material is abnormal.

5. A trimmer according to any one of claim 1, wherein the trimmer is a three-side trimmer;

wherein the trimmer comprises:

a fore-edge trimming part that trims a fore-edge area of the bound material; and a top and bottom edges trimming part that trims top and bottom edge areas of the bound material; and wherein the positioning part is mounted on the fore-edge trimming part.

* * * * *